United States Patent [19]

Ray et al.

[11] 4,281,613

[45] Aug. 4, 1981

[54] METHOD OF AND APPARATUS FOR MOORING A FLOATING STRUCTURE

[75] Inventors: Donald R. Ray; Riddle E. Steddum, both of Houston, Tex.

[73] Assignee: The Offshore Company, Houston, Tex.

[21] Appl. No.: 96,075

[22] Filed: Nov. 20, 1979

Related U.S. Application Data

[63] Continuation of Ser. No. 827,145, Aug. 24, 1977, abandoned.

[51] Int. Cl.[3] ..... B63B 21/50

[52] U.S. Cl. ..... 114/230; 114/265; 114/293

[58] Field of Search ..... 9/8 P; 114/230, 264, 114/265, 293; 175/7; 166/352, 354; 405/224, 225, 228

[56] References Cited

U.S. PATENT DOCUMENTS

| | | | |
|---|---|---|---|
| 3,513,911 | 5/1970 | Petersen | 175/7 X |
| 3,540,396 | 11/1970 | Horton | 114/265 |
| 3,563,042 | 2/1971 | Ryan | 114/265 X |
| 3,603,386 | 9/1971 | Talley, Jr. | 175/7 X |
| 3,605,668 | 9/1971 | Morgan | 114/293 |
| 3,618,661 | 11/1971 | Peterman | 175/7 X |
| 3,745,774 | 7/1973 | Sharp, Jr. | 405/225 |
| 3,955,521 | 5/1976 | Mott | 114/265 |
| 3,979,785 | 9/1976 | Flory | 9/8 P |
| 3,984,991 | 10/1976 | Kagler, Jr. | 175/7 X |

FOREIGN PATENT DOCUMENTS

| | | | |
|---|---|---|---|
| 2312598 | 12/1976 | France | 114/293 |

*Primary Examiner*—Sherman D. Basinger
*Attorney, Agent, or Firm*—Bradford E. Kile

[57] ABSTRACT

A tension mooring system for a floating structure such as a drilling or production platform having a plurality of permanent mooring lines extending upwardly from a plurality of bottom anchors and terminating below the water level and having buoys connected to the upper ends thereof with sufficient buoyancy to maintain the upper end of the mooring lines in a generally vertical posture, replaceable mooring lines connecting from the buoys to the floating structure, the upper position of the permanent mooring lines being preselected to be below a highly corrosive area of the air-sea interface, and a pulling mechanism on the replaceable mooring lines to impart a preselected tension to the mooring lines, the bottom anchors being pre-positioned by drilling and cementing or driving piling through templates. The method of establishing a tension mooring system for a floating structure including the steps of placing a plurality of drilling templates on the bottom at the desired mooring site, drilling and cementing or driving anchor piles through the templates, lowering permanent mooring lines, remotely connecting them to the templates, connecting replaceable mooring lines from the floating structure to the buoys secured to the upper end of the permanent mooring lines, and tensioning the mooring lines to a preselected level.

16 Claims, 9 Drawing Figures

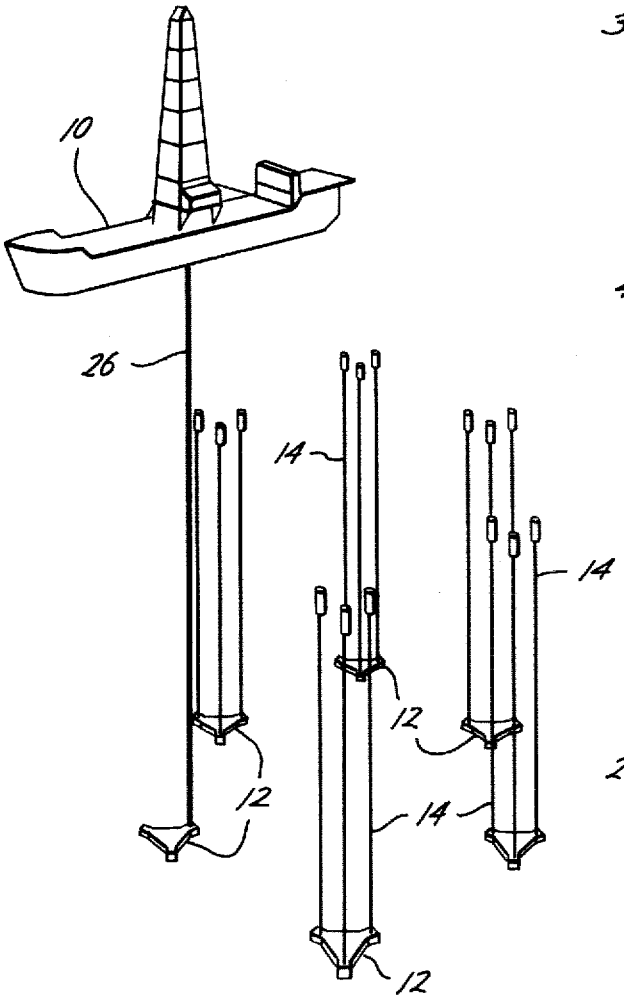
Fig. 1
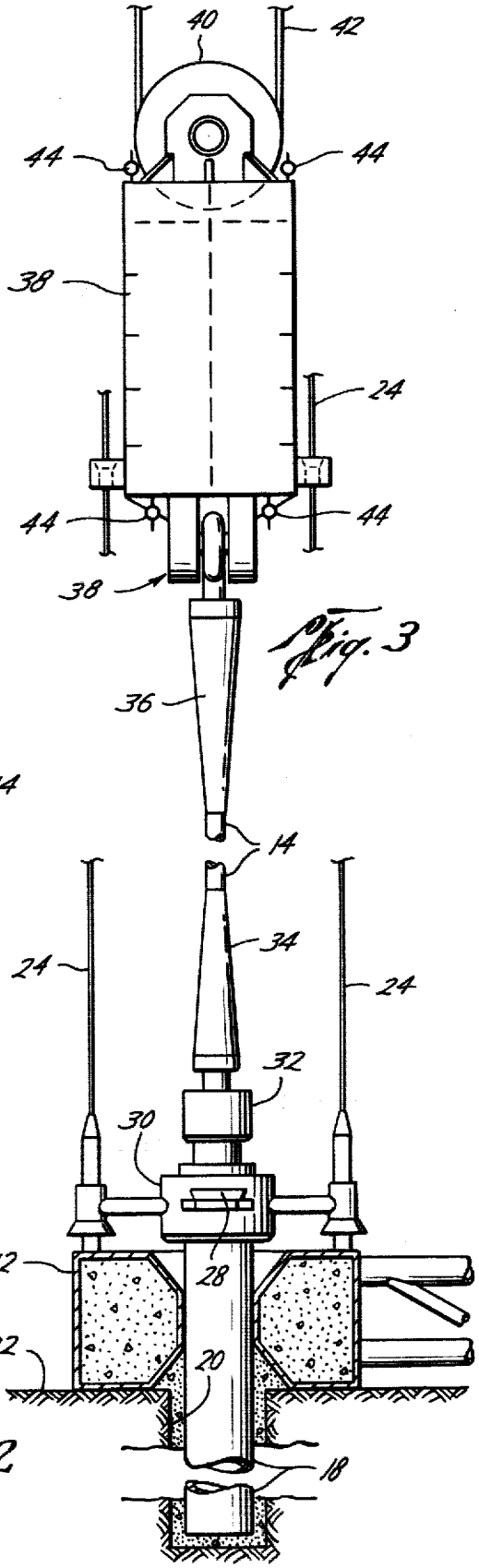
Fig. 3
Fig. 2

METHOD OF AND APPARATUS FOR MOORING A FLOATING STRUCTURE

This is a continuation of application Ser. No. 827,145, filed Aug. 24, 1977, now abandoned.

BACKGROUND OF THE INVENTION

Mooring systems for floating structures have been proposed which include a plurality of mooring lines anchored to the bottom and connected at their upper ends to the floating structure and extending in substantially parallel relationship to each other with the buoyancy of the floating structure being used to maintain the mooring lines under a preselected tension. In this form of mooring system, the floating structure is held substantially level and horizontal movement away from a preselected site introduces forces in the mooring lines urging the structure toward its equilibrium position.

It has been suggested to utilize templates on the bottom for multiple drilling and for making production connections. Also, it is well known to have guide lines extending from such drilling template and landing bases to the surface of the water to allow equipment to be lowered into proper position on the template. Still further it has been previously known that floats may be secured to guide lines at a point below the water surface to allow a vessel to disconnect from the lines and later relocate the lines by sonar and manually recover them. Others have further suggested that the use of buoyant members to support mooring lines at intermediate positions below the surface of the water. Additionally others have disclosed a buoy or a riser pipe and a line connecting to a secondary buoy or the surface to allow disconnecting from the riser pipe during a storm and relocation of the surface buoy.

Still further it has been disclosed that a mooring cable may be connected to a buoy and a rope or steel cable connecting from the buoy to the floating structure. The buoy surrounds and maintains the upper end of the mooring cable at or near the water surface.

It has been previously suggested that the anchor system for a tension moored drilling and production platform could be set by the platform when it is delivered to the drilling site. This notion is best applied when gravity anchors are to be used instead of piling and has been previously disclosed in a Ray U.S. Pat. No. 3,919,957, of common assignment with the instant patent. However, gravity anchors are large and heavy structures which represent additional complication and expense in the fabrication of a platform in order that it be capable of setting such structures. This complication is worthwhile for a mobile platform which is intended to be moved frequently during its lifetime. In the case of a more permanent installation, however, it is more economical and timely to utilize anchor piling which can be placed while the drilling or production platform is being constructed. Thus, the anchorage system is ready for connection to the platform when said platform is delivered to the intended site. In this manner valuable time is saved in platform installation and drilling and production of a petroleum reservoir can begin more quickly.

Corrosion of mooring lines is a primary consideration in the use of tension moored platforms because the mooring lines are primary structural elements under considerable tension. Failure of the mooring lines may represent a costly delay to the drilling and production activities and may even result in damage to the floating platform. Such a failure may result from loss of strength of the mooring lines as corrosion reduces their available cross sectional area. It is well known that the most corrosive environment for mooring cables is near the interface between sea and air, commonly referred to as the splash zone. Here water is highly oxygenated from mixing due to wind and wave action. Furthermore, constant wave action erodes the oxides away from the metallic surface exposing new metal to be attacked by corrosion. Protective coatings can be used on mooring lines within the splash zone as long as said lines require no handling or manipulation. Where handling is required, however, the coating is soon destroyed which renders the remaining coating essentially useless.

BRIEF SUMMARY AND OBJECTS OF THE INVENTION

The present invention relates to an improved tension mooring system and to an improved method for establishing a tension mooring system for a floating structure.

The improved tension mooring system includes anchor positioning templates through which anchor piles are drilled and cemented or driven in preselected locations. Permanent mooring lines are remotely connected to the anchor piles, and have a corrosion resistant coating or comparable protection. These permanent mooring lines extend to a level below the water surface at which level they are supported by buoys. Replaceable or sacrificial mooring lines are then connected from the buoys to the moored floating structure.

With the present invention, the anchor piles may be placed, and the permanent mooring lines remotely connected from a small drilling vessel so that the mooring system is ready to receive the permanent floating structure when it arrives at the mooring site. This allows maximum usage of the large permanent floating structure by reducing the time taken to set up and complete establishment of the mooring system.

An object of the present invention is to provide an improved tension mooring system and method of establishing such system for a floating structure which may be established prior to the arrival of a permanent floating structure at the mooring site.

Another object of the invention is to provide an improved tension mooring system for a floating structure which minimizes corrosion for most of the length of each of the mooring lines and provides for simple and easy replacement of the remaining portion of the lines which portion is subject to the severest corrosion conditions.

A further object of the invention is to provide an improved tension mooring system for a floating structure in which the portions of the mooring lines which are passed through tensioning apparatus are easily and simply replaceable.

BRIEF DESCRIPTION OF THE DRAWINGS

These and other objects of the present invention are hereinafter set forth and explained with reference to the drawings wherein, FIG. 1 is a perspective view of the step of drilling in anchor piles for a tension mooring system of the present invention prior to the arrival of the permanent floating structure at the mooring site;

FIG. 2 is a sectional view of a template, anchor and connection of permanent mooring lines to the anchor in accordance with the improved mooring system of the present invention;

FIG. 3 illustrates a buoy supporting an upper end of the permanent mooring lines of the present invention;

DESCRIPTION OF THE PREFERRED EMBODIMENT

Figure 9:
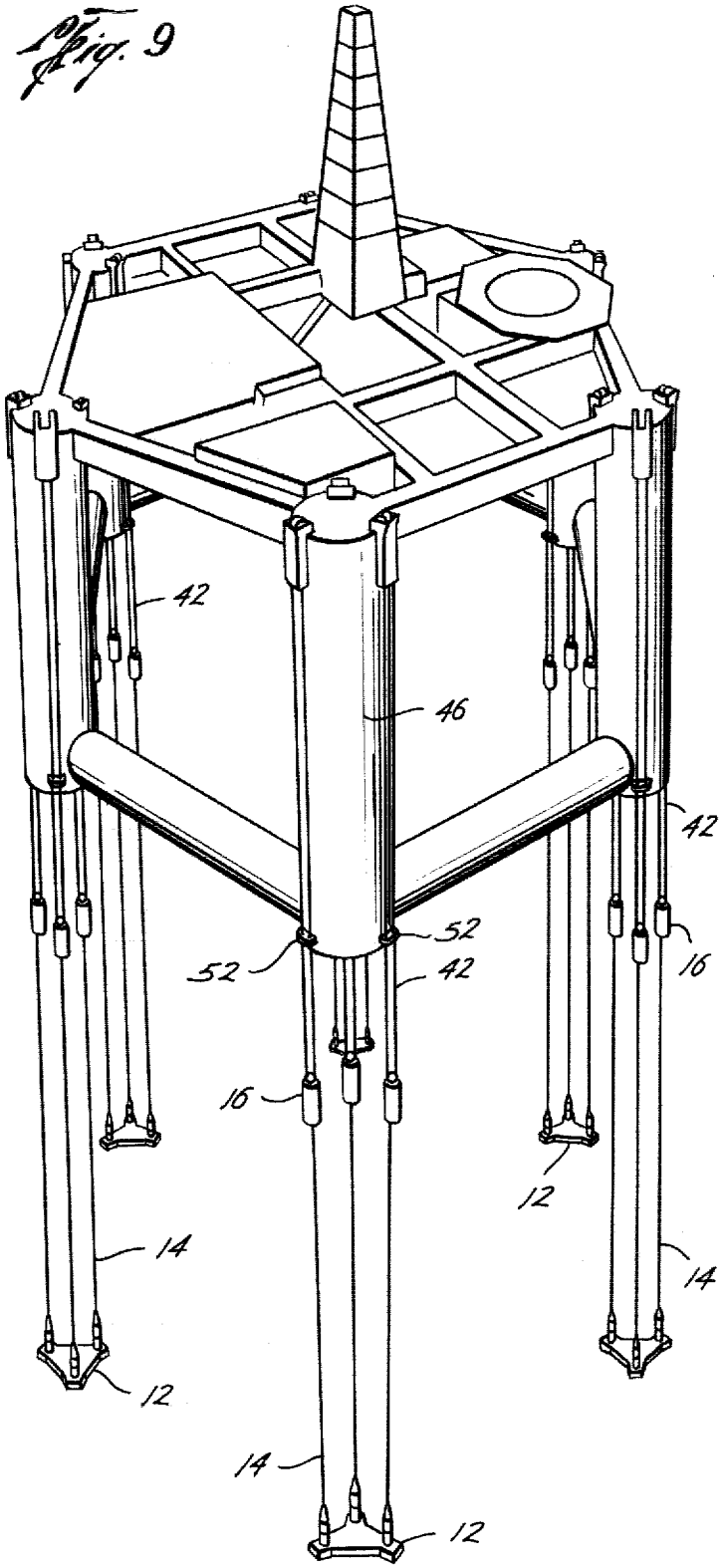
FIG. 9 is a perspective view of the improved mooring system of the present invention with the floating structure secured in position by such system.

Referring now to the drawings wherein like numerals indicate like parts and particularly to FIG. 1, a service type of drilling vessel 10 which has completed drilling and setting anchor piles through several anchor templates 12 and is in the process of drilling the anchoring of the last of the templates 12. The permanent mooring lines 14 have been secured to the anchor piles 18 and each of the lines 14 is supported at its upper end by buoys 16.

The anchors include a pipe or casing 18 (note FIGS. 2 and 8) which is lowered through the template 12 into the bore hole 20 and the casing 18 is cemented within the bore hole as shown. Alternatively, the anchor piling may be driven through the templates. The templates 12 are located on the bottom 22 of a body of water in a pattern which in a tension mooring installation is the outline of the floating structure to be moored. The templates are lowered onto their location with guide lines 24 extending to the drilling vessel 10. If a casing 18, separate from a drill string 26 is to be used for the anchor, the guide lines 24 are used to lower the casing 18 into position. Most often, the guide lines 24 and the drill string 26 are used in setting casing 18 to assure that a landing base 28 is positioned in its proper location. Connected to the lower end of the permanent mooring line 14 is a connector 30 which is adapted to be remotely actuated for connection of the permanent mooring lines 14 to the casing or anchor pile 18.

When the mooring line 14 is connected to the anchor pile 18 as shown in FIG. 2, a flexible joint 32 is positioned above the connector 30 to which a tendon end 34 of the mooring line 14 is connected. The mooring line 14 may be of any suitable construction such as a cable, pipe or other tension element but is preferred to be a large diameter steel cable of parallel strand construction with an exterior corrosion resistant coating of a material such as polyurethane to protect the cable from corrosion.

The upper end of mooring line 14 terminates in a tendon end 36 which is secured to the mooring buoy 16 as shown in FIG. 3. A connection 38 between the tendon end 36 and the buoy 16 may comprise any suitable connection structure with a pivotal or other flexible connection being preferred. It is also preferred that the buoys 16 be positioned sufficiently below the level of water to be out of water turbulence and a high corrosive, high oxygen content water near the surface and below the floating platform. With the permanent mooring lines 14 being provided with corrosion protective means and not extending into the more corrosive water near the surface, replacement of the permanent mooring lines 14 is minimized or eliminated.

A large diameter sheave 40 is mounted on the upper end of buoy 16 to receive a sacrificial mooring line 42. With the mooring line 42 around the sheave 40, line 42 may be tensioned to provide a desired tensioning of the combined mooring line 14 and 42. Also as will be later explained, the lines 42 may be replaced without being disconnected from the buoys 16.

The buoy 16 is constructed with valving 44 above and below the buoy with all valves being operable from the top of the buoy by a diver. The buoy 16 includes a chamber charged with compressed air so that its buoyancy may be adjusted by a diver manipulating the valving 44.

The buoy 16 supports its own weight, the weight of the permanent mooring line 14, and generates sufficient buoyancy to exert a small additional tension in the mooring lines. In so doing, the buoy 16 removes the requirement that the floating platform provide the buoyancy necessary to offset the weight of the permanent mooring apparatus. By removing this requirement the floating platform may be designed with reduced displacement or, alternatively, with higher payload capacity for the same displacement.

Figure 4:
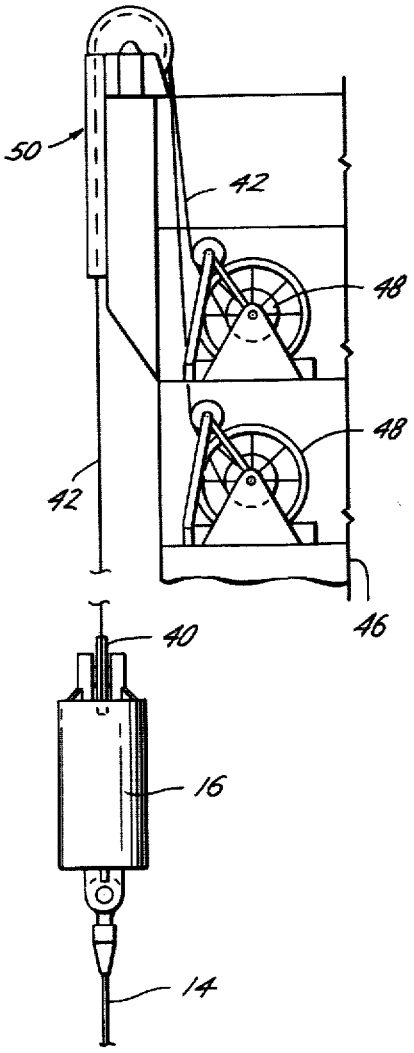
FIG. 4 is an elevation view of replaceable or sacrificial mooring lines, storage reels, tensioning means and a connection of the sacrificial lines to the buoy at the upper end of the permanent mooring lines.
Figure 5:
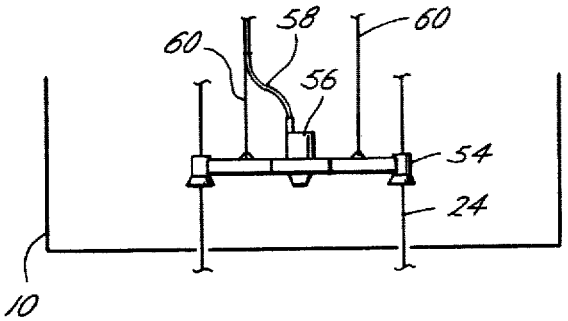
FIG. 5 is a side view of a guide frame and remotely controlled actuator being lowered on guide lines from a floating structure.

The sacrificial mooring lines 42, their connection around the sheaves 40 on buoys 16 and their storage and handling systems aboard a moored floating structure 46 are shown in FIG. 4. The lines 42 are stored on reels 48 and pass from one of the reels 48 through a tensioning means 50 downward to the buoy 16, under the sheave 40, upward to the tensioning means 50 and onto the other of the reels 48. In this structure, the lines 42 may be replaced by unwinding new cable from one of the reels 48 and winding old cable onto the other reel 48. It is suggested that the line 42 be periodically checked and replaced to avoid problems which result from corrosion of or other damage to these lines. Suitable guides or fairleads 52, note FIG. 9, are provided for the sacrificial mooring lines 42.

The improved tension mooring system of the present invention is shown in FIG. 9 mooring the floating structure 46 in its desired location. The floating structure 46 illustrated is shown to be a drilling platform but may be any type of floating structure which is desired to be moored at a particular location.

The steps taken in installation of the permanent mooring lines 14 and buoy apparatus 16 are shown in FIGS. 2 and 5 through 8. After the anchors 12 have been secured in place either by drilling and cementing of the casing 18 in the bore hole 20 or, alternatively, by driving anchor piling into the sea bed through the guide template 12, the permanent mooring line assembly is prepared for deployment. Connector 30 is attached to the lower end of the flexible joint 32 by bolted flanges or other suitable means. A remotely operated actuator 56 with actuator lead 58 is engaged on the landing base 28 on the connector 30 and is fixed in proper orientation by guide frame 54. Guide frame 54 is designed such that the guide funnels at the ends of its arms fit over the longer but more slender guide funnels of the arms on the connector 30. The funnels associated with connector 30 are sized to fit over the guide posts of template 12.

The actuator lead 58 may be a hydraulic line if actuator 56 is hydraulically actuated or an electric conductor if actuator 56 is electrically actuated. If actuator lead 58 is an electric conductor, then actuator 56 may be actuated by a hydraulic fluid reservoir on the actuator which is pressurized by a small bank of accumulators charged with high pressure gases which are released by electric signals commonly referred to as an electro-hydraulic system. In any case, actuator lead 58 provides communication between the platform 40 and the connector 30. Actuator 56 is designed to provide remote actuation to latch and unlatch connector 30 onto the top of anchor pile 18.

When the permanent mooring system is initially deployed, the guide frame 54 with actuator 56 engaged in landing base 28 on the connector 30 are lowered simultaneously. When connector 30 engages the top of anchor pile 18, the connector is actuated and securely latched to the anchor pile 18. In order to permit the lowering of mooring line 14 into the desired position and to permit latching to the anchor pile 18, the buoy 16 must be flooded to the extent that the entire apparatus is negatively buoyant. The apparatus is lowered and supported by temporary lines extending to the service vessel 10 and is guided into proper orientation with guide lines 24. When the connector 30 has been securely latched to anchor pile 18, the buoy 16 is evacuated by compressed air until the desired tension is obtained in the mooring lines. At this point, the guide frame 54 with actuator 56 is recovered to the service vessel 10 using guide lines 24 and lifting lines 60.

Figure 6:
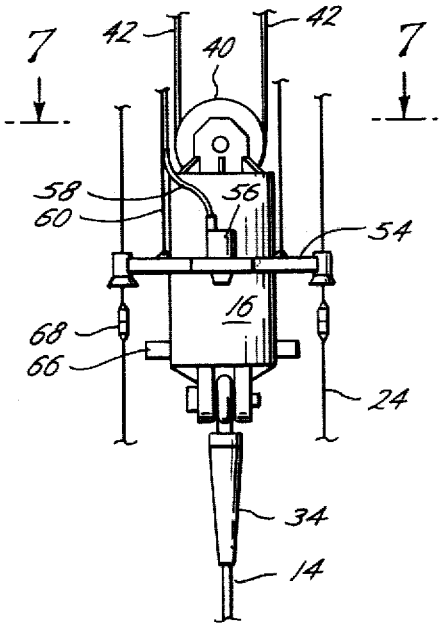
FIG. 6 is a side view of a guide frame and remotely controlled actuator passing the permanent mooring line buoy.
Figure 7:
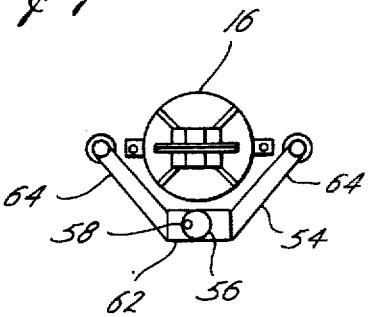
FIG. 7 is a plan view taken along section line 7—7 in FIG. 6 showing the guide frame passing the buoy.
Figure 8:
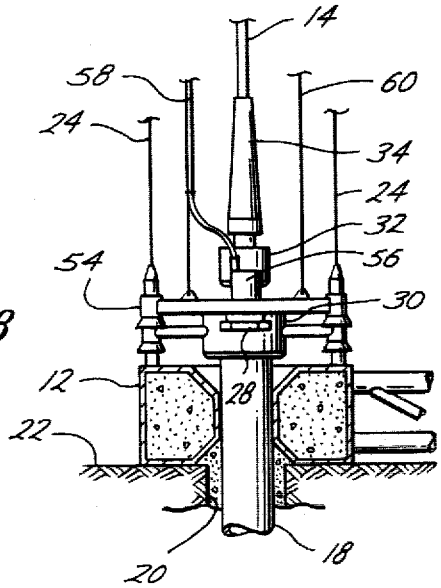
FIG. 8 is a side view with the guide frame seated on the anchor template and the remotely controlled actuator in engagement with the landing base for connecting the permanent mooring line to the anchor.

As can be seen, the guide frame 54 is constructed to have a central portion 62 on which the actuator 56 is positioned and arms 64 extending from the central portion 62 at an angle as best shown in FIGS. 6 and 7. The outer portion of each of arms 64 engages the guide lines 24 and the central portion is offset to pass the buoy 16 without difficulty and to position actuator 56 for engagement on landing base 28 so that it is in engagement for remote operation of the connector 30. The landed position of the guide frame 54 on the anchor 12 with the actuator 56 engaging the landing base 28 is shown in FIG. 8.

The guide lines 24 are positioned such that the guide frame 54 may be moved past buoy 16 without requiring the mooring lines to be disconnected. Suitable attachment brackets 66 are positioned on the buoy 16 to permit the guide lines 24 to be supported by the buoy 16 when guide lines 24 are not in use. Guide lines 24 are fitted with connectors 68 which allow the upper portions of the guide lines to be removed and the lower portions to be supported from buoy 16 at brackets 66. Thus, the lower portions of the guide lines are left in place permanently and are available for future use in the event that it becomes necessary or desirable to recover mooring lines 14. Although the lower portions of guide lines 24 are out of the high corrosion zone, it is preferable that they be further protected from corrosion by a suitable coating.

The final step in deployment of the permanent mooring apparatus is to place tag lines (not shown) around the sheave 40 on buoy 16 and terminate the ends of the tag lines at the water surface with marker buoys (not shown).

Thereafter, when the floating structure 46 arrives, the replaceable mooring lines 42 are connected by divers to tag lines passing under the sheaves 40 on the buoys 16 and the replaceable mooring lines 42 are then advanced under the sheave 40 and finally into their desired position. By suitable tensioning of the mooring lines and ballasting and deballasting of floating structure 46, the improved tension mooring system of the present invention is established and the operations of the floating structure may commence.

What is claimed is:

1. A tension mooring system for a floating platform comprising:

a floating platform;

anchor means positioned upon the bed of a body of water;

mooring lines secured to said anchor means and extending upwardly therefrom;

buoyant means connected to the upper ends of said mooring lines at a point below the lowest water surface; and means for connecting said mooring lines to said floating platform, said connecting means for each of said mooring lines including, a length of sacrificial mooring line, a sheave secured to said buoyant means, a first reel on said floating platform, a second reel on said floating platform, and means for tensioning said sacrificial mooring line, said sacrificial mooring line being wound on said first reel and extending around said sheave and through said tensioning means to said second reel whereby tension in said mooring line may be maintained at a preselected level and said sacrificial mooring line may be replaced with the additional sacrificial mooring line wound on said first reel.

2. A tension mooring system for a floating platform as defined in claim 1 wherein:

said anchor means comprises a plurality of individual templates secured to the bed of the body of water;

said mooring lines extend upwardly in generally mutual parallel relationship; and said buoyant means comprises a plurality of individual buoys, one being connected to the upper end of each of said mooring lines.

3. A tension mooring system for a floating platform as defined in claim 2 wherein:

said mooring lines secured to said anchor means and said sacrificial mooring lines are composed of steel cables.

4. A tension mooring system for a floating platform as defined in claim 3 wherein:

said steel cable mooring lines secured to said anchor means are coated with polyurethane to protect the steel cable from corrosion.

5. A tension mooring system for a floating platform comprising:

anchor means positioned upon the bed of a body of water;

permanent mooring lines secured to said anchor means and extending upwardly;

buoyant means directly connected to the upper ends of said permanent mooring lines at a location below a zone of high corrosive, high oxygen content water adjacent the surface of the body of water said connection location further being below the lowest portion of the platform and said permanent mooring lines being dimensioned to maintain said buoyant means in a submerged posture below the zone of high oxygen content water and the lowest portion of the platform;

sacrificial mooring lines connected to a submerged upper portion of said buoyant means and extending upwardly to the floating platform;

means for connecting sacrificial mooring lines to the floating platform wherein the floating platform is located with respect to said anchor means by tension applied through said sacrificial mooring lines and said permanent mooring lines; and means operably connected to the platform for selectively replacing said sacrificial mooring lines between said buoyant means and the floating platform upon damage to said sacrificial lines, said means being operable to selectively replace said sacrificial mooring lines without releasing said permanent mooring lines from a secure direct connection to said submerged buoyant means.

6. A tension mooring system for a floating platform as defined in claim 5 wherein said means for selectively replacing said sacrificial mooring lines each further comprises:

means for tensioning a sacrificial mooring line between said buoyant means and said floating platform.

7. A tension mooring system for a floating platform as defined in claim 5 wherein:

said buoyant means comprises a plurality of individual buoys, one of said buoys being mounted to the upper end of each of said permanent mooring lines; and said anchor means comprises a plurality of templates positioned in a uniform pattern upon the bed of the body of water and being secured to the waterbed by anchor piles extending through the templates and into the waterbed.

8. A mooring system for a floating platform comprising:

anchor means positioned upon the bed of a body of water;

at least one permanent mooring line secured to said anchor means and extending upwardly;

buoyant means directly connected to the upper end of said at least one permanent mooring line, said buoyant means being retained by said at least one permanent mooring line in a submerged posture and at a location below a zone of high corrosive, high oxygen content water adjacent the surface of the body of water and below the lowest portion of the floating platform;

at least one sacrificial mooring line connected to the submerged buoyant means and extending upwardly to the floating platform;

means for connecting said at least one sacrificial mooring line to the floating platform wherein the floating platform is located upon the body of water with respect to said anchor means by said at least one sacrificial mooring line, said buoyant means and said at least one permanent mooring line; and means operably connected to the floating platform for selectively replacing said at least one sacrificial mooring line between said buoyant means and the floating platform upon damage of said at least one sacrificial mooring line, said means being operable to selectively replace said at least one sacrificial mooring line without releasing said at least one permanent mooring line from a secure direct connection to said submerged buoyant means.

9. A mooring system for a floating platform as defined in claim 8 and further comprising:

means operably connected to the floating platform for applying tension to said at least one sacrificial mooring line.

10. A mooring system for a floating platform as defined in claim 8 wherein:

said permanent and said at least one sacrificial mooring line are composed of steel cables.

11. A mooring system for a floating platform as defined in claim 8 wherein:

said permanent and said at least one sacrificial mooring line are composed of tubular pipe.

12. The method of establishing a mooring system for a floating platform including the steps of:

setting an anchor on the bottom of a body of water with guide lines extending from said anchor to the water surface;

lowering permanenet mooring lines on said guide lines to position the lower end of the permanent mooring lines in contact with the anchor and the upper end of the permanent mooring lines being supported by a buoy at a level below the water surface;

securing the lower end of the permanent mooring lines to the anchor;

securing replaceable mooring lines to said buoys;

reaving each replaceable mooring line from a first storage reel aboard the floating platform to be moored by such mooring system through a tensioning apparatus, around a sheave secured to said buoy and back to a second reel aboard said floating platform; and in the event it is desired to replace said replaceable mooring line, paying out replaceable mooring line from the first storage reel and taking up replaceable mooring line on the second storage reel.

13. A method as defined in claim 12 wherein said setting step includes:

drilling and cementing anchor piles through templates to provide said anchors.

14. A method as defined in claim 12 wherein said setting step includes:

driving anchor piles through templates to provide said anchors.

15. A tension mooring system for a floating platform comprising:

anchor means positioned upon the bed of a body of water;

permanent mooring lines secured to said anchor means and extending upwardly;

buoyant means connected to the upper ends of said permanent mooring lines at a location below a zone of high corrosive, high oxygen content water adjacent the surface of the body of water said connection location further being below the lowest portion of the platform and said permanent mooring lines being dimensioned to maintain said buoyant means in a submerged posture below the zone of high oxygen content water and the lowest portion of the platform;

sacrificial mooring lines connected to a submerged upper portion of said buoyant means and extending upwardly to the floating platform;

means for connecting sacrificial mooring lines to the floating platform wherein the floating platform is located with respect to said anchor means by tension applied through said sacrificial mooring lines and said permanent mooring lines; and means operably connected to the platform for selectively replacing said sacrificial mooring lines between said buoyant means and the floating platform upon damage to said sacrificial lines, said means for selectively replacing includes a sheave secured to said buoyant means and a sacrificial mooring line extending from said floating platform downwardly around said sheave and back to said platform; and means for taking up one end of the sacrificial mooring line and paying out the other end thereof until the length of sacrificial mooring line extending between the floating platform and said buoyant means is replaced.

16. A tension mooring system for a floating platform as defined in claim 15 wherein said means for taking up and paying out comprises:

a first reel mounted upon the floating platform wherein one end of said sacrificial mooring line is mounted upon said first reel and to take up lengths of sacrificial mooring line; and a second reel mounted upon the floating platform wherein the other end of said sacrificial mooring line is mounted upon said second reel to pay out lengths of sacrificial mooring line.

* * * * *